US005750014A

United States Patent [19]

Stadler et al.

[11] Patent Number: 5,750,014

[45] Date of Patent: *May 12, 1998

[54] APPARATUS FOR SELECTIVELY COATING METAL PARTS

[75] Inventors: David M. Stadler, Lathrup Village; Jeffrey R. Pernick, Commerce, both of Mich.

[73] Assignee: International Hardcoat, Inc., Detroit, Mich.

[ * ] Notice: The term of this patent shall not extend beyond the expiration date of Pat. No. 5,534,126.

[21] Appl. No.: 677,164

[22] Filed: Jul. 9, 1996

Related U.S. Application Data

[63] Continuation of Ser. No. 540,655, Oct. 11, 1995, abandoned, which is a continuation-in-part of Ser. No. 386,012, Feb. 9, 1995, Pat. No. 5,534,126.

[51] Int. Cl.[6] ..... C25B 15/00; C25D 17/04; C25D 5/02; C25D 7/00

[52] U.S. Cl. ..... 204/224 R; 204/237; 204/275; 204/297 R; 204/297 W; 205/101; 205/118; 205/136; 205/137; 205/145; 205/151; 205/224; 205/324

[58] Field of Search ..... 204/224 R, 237, 204/275, 297 R, 297 W; 205/137, 145, 151, 101, 118, 136, 224, 324

[56] References Cited

U.S. PATENT DOCUMENTS

| | | | |
|---|---|---|---|
| 2,698,832 | 1/1955 | Swanson | 204/224 |
| 2,745,805 | 5/1956 | Jones, Jr. | 204/279 |
| 3,573,176 | 3/1971 | Laznovsky | 204/15 |
| 4,118,303 | 10/1978 | Gibbs | 204/224 |
| 4,443,304 | 4/1984 | Eidschun | 204/27 |
| 5,032,244 | 7/1991 | Bommier et al. | 204/224 |
| 5,173,161 | 12/1992 | Gramm | 204/232 |
| 5,534,126 | 7/1996 | Stadler et al. | 205/101 |

FOREIGN PATENT DOCUMENTS

| | | |
|---|---|---|
| 0 232 211 | 2/1987 | European Pat. Off. . |
| 2354450 | 6/1977 | France . |
| 727406 | 3/1955 | United Kingdom . |

*Primary Examiner*—Kathryn L. Gorgos
*Assistant Examiner*—Edna Wong
*Attorney, Agent, or Firm*—Dykema Gossett PLLC

[57] ABSTRACT

An apparatus for simultaneously anodizing the heads of several aluminum pistons includes a plating tank with an array of apertures extending through one side wall, one aperture for each piston; a fixture on the wall providing a cylindrical bore aligned with each aperture adapted to receive a piston; and a plurality of actuators which, when pivoted and locked into alignment with the fixture bores, operate to secure individual pistons in their respective apertures. A masking/sealing assembly within each fixture bore ensures that each aperture is sealed upon the securing of a piston therein, with only the piston's head and peripheral land being placed in fluid communication with the interior of the plating tank. A remote storage tank provides a supply of an electrolyte which is circulated by a fluid supply network between the storage tank and the thus-sealed plating tank during electrolysis. After the desired coating is achieved, the electrolyte is drained from the tank. A supply of rinse water is then directed through the plating tank to rinse any remaining electrolyte from the pistons, whereupon the actuators are retracted and pivoted free, and the coated pistons are removed from their respective fixtures and masking/sealing assemblies.

20 Claims, 4 Drawing Sheets

APPARATUS FOR SELECTIVELY COATING METAL PARTS

CROSS-REFERENCE TO RELATED APPLICATIONS

The present application is a continuation of U.S. patent application Ser. No. 08/540,655 filed Oct. 10, 1995, now abandoned, which is a continuation-in-part of U.S. patent application Ser. No. 08/386,012 filed Feb. 9, 1995, now U.S. Pat. No. 5,534,126, and entitled "Apparatus For Selective Coating Of Metal Parts," also assigned to the assignee of the present invention.

BACKGROUND OF THE INVENTION

The present invention generally relates to apparatus for simultaneously coating selected surface portions of a plurality of like metal parts using an electrolytic deposition process, as might be advantageous for hardcoat anodizing the heads and adjacent peripheral lands of aluminum pistons to be used in an internal combustion engine. More specifically, the invention relates to apparatus for continuously processing such metal parts with minimal handling to obtain coatings of superior quality and consistency while simultaneously lessening their relative cost.

Known apparatus for simultaneously coating selective surface portions of a plurality of like metal parts, such as the head and adjacent peripheral lands of aluminum pistons, generally include several different baths, each containing an appropriate cleaning, etching, plating and/or rinsing solution needed to generate the desired single or multilayered coating. Such known apparatus also includes complex materials-handling equipment with which to simultaneously transport and "dip" the metal parts in each bath. As a result, such prior art apparatus requires a large physical plant to house both the materials-handling equipment and the requisite processing baths, implicating substantial capital investment.

And, while some prior art processes for producing multilayered coatings on metal parts may themselves reduce the number of physical "dips" required, as through use of a single bath containing a "mixed" plating solution combined with alternating anodic and cathodic plating steps, as taught in U.S. Pat. No. 3,556,958 to Hutchings et al, there nonetheless remains a substantial need for the handling of individual and/or racked workpieces during such processes. Such handling, in turn, can adversely impact the overall quality and consistency of the resulting coating while further increasing its relative cost, both in terms of increased coating times and equipment/capital requirements.

Moreover, in the event that only a portion of the workpiece is to be coated, as where a coating is sought only on the head and adjacent peripheral lands of a piston (e.g., along the piston's cylindrical peripheral surface as until the first circumferential groove formed therein), known apparatus must further include masking means, to be individually applied to each workpiece prior to dipping. The masked workpieces must thereafter be handled without disturbing the mask, thereby further complicating the necessary materials-handling equipment.

Another problem encountered with known apparatus for coating metal parts lies in the fact that, for many prior art processes to be used therewith, some of the baths must be maintained at temperatures other than at room temperature. For example, it is well known that the optimal temperature of the sulfuric acid electrolyte used in the hardcoat anodizing of 6000-series aluminum alloys is 32±2° F. (0±1° C.), with the parts perhaps being subsequently dipped into hot water maintained at a temperature of at least 200° F. (95° C.) for perhaps 15 minutes in order to hydrate/seal the resulting aluminum-oxide coating. Similarly, the nominal temperature of a chromic acid electrolyte bath is preferably 100±9° F. (37±5° C.).

Given the open processing tanks typical of such known coating apparatus, the apparatus requires a further means for heating or cooling its various solutions to the proper temperature. The latent heat of the sizable racks and other materials-handling equipment of such prior art apparatus must also be factored into the energy equation, requiring still larger processing tanks and greater quantities of solutions.

Moreover, the use of open processing baths exposes workers to fumes generated either by the solutions themselves or as a byproduct of electrolysis, with the intensity of the fumes almost certainly increased through requisite agitation of each bath. And, since the processing baths must remain open for substantial periods to accommodate the parts-handling equipment, there is little opportunity to recover such fumes and, hence, greater harm to the environment.

Accordingly, what is needed is a semi-automatic method for the selective coating of metal parts, such as pistons, which avoids the aforementioned problems and provides a single or multilayered coating of superior quality and consistency, preferably at a lower cost.

SUMMARY OF THE INVENTION

It is an object of the invention to provide an apparatus for simultaneously coating of selected surface portions of a plurality of metal parts featuring reduced handling of such metal parts.

It is another object of the invention to provide an apparatus for simultaneously coating of selected surface portions of a plurality of metal parts featuring simplified means for masking-off areas on those parts.

It is another object of the invention to provide an apparatus for simultaneously coating of selected surface portions of a plurality of metal parts requiring smaller amounts of the various processing solutions.

It is another object of the invention to provide an apparatus for simultaneously coating of selected surface portions of a plurality of metal parts which requires smaller amounts of energy.

A further object of the invention is to provide an apparatus for simultaneously coating of selected surface portions of a plurality of metal parts featuring reduced worker exposure to the various solutions used therein and, particularly, to the byproducts of electrolysis.

Yet another object of the invention is to provide an apparatus for simultaneously coating of selected surface portions of a plurality of metal parts which maintains its various processing solutions, and performs each of its processing steps, within sealed containers, thereby promoting increased environmental safety while reducing energy requirements and evaporative loss.

Under the invention, an apparatus for simultaneously coating a first selected surface portion of each of a plurality of electrically-conductive workpieces includes a plating tank having an interior defined, in part, by a first wall which itself includes a plurality of apertures formed therein adapted to receive the workpieces, one workpiece to each aperture. The plating tank is also provided with a drain. The apparatus further includes a means for temporarily securing each workpiece relative to its respective aperture so as to place the first surface portion of each workpiece in fluid communication with the interior of the plating tank; and means for sealing each aperture about its respective workpiece when the workpiece is secured relative to its aperture, whereby the sealing means further operates to mask-off areas on the workpiece on which no coating is to be generated.

Thus, in a preferred embodiment of the apparatus, the means for temporarily securing the workpiece in the aperture includes a fixture adapted to receive the workpiece, and an actuator pivotally mounted on the plating tank for translating the workpiece supported by the fixture towards the aperture once the actuator is pivoted and locked into alignment with the aperture. For example, where the workpiece is a piston whose head and peripheral land are to be coated in accordance with the invention, the fixture is preferably a cylindrical support or "cradle" aligned with the aperture, within which the piston may be manually inserted. A pivoting frame mounted to the front wall of the plating tank, itself supporting a number of pneumatic actuators, is then rotated towards the front wall of the plating tank in the same manner as one might close the door of a china cabinet, whereupon an actuator is pivoted into axial alignment with each aperture.

Also in a preferred embodiment, the means for sealing each aperture about its respective workpiece itself includes at least one arcuate keying element which engages a second surface portion of the workpiece, such as a piston's circumferential groove, to provide an axial load-bearing surface projecting from the piston with which to support an annular collar which itself encompasses a longitudinal portion of the piston. The sealing means further includes a seal, such as an O-ring seal, which is disposed between a sealing surface on the collar and a complementary, opposed sealing surface within either the fixture or the aperture. The seal is compressed upon the securing of the piston within the fixture/aperture.

Under the present invention, the apparatus further comprises an electrode extending into the plating tank; and a fluid supply network which includes a remote storage tank containing a supply of an electrolyte, a supply conduit extending from the storage tank to the plating tank, a pump operative to pump electrolyte stored in the storage tank through the supply conduit into the plating tank, and a first return conduit extending from the drain of the plating tank to the storage tank. Once the plating tank's apertures are "plugged" by the workpieces, the fluid supply network is operated to direct the electrolyte into the plating tank such that the electrolyte bridges each of the workpieces and the electrode. The apparatus also includes a power supply connected to each workpiece and the electrode, respectively, for applying a current across the bridging electrolyte, whereby an electrolytic coating is generated on the first surface portion of each workpiece. In this regard, it is noted that the electrolyte is continuously circulated between the storage tank and the plating tank during electrolysis, thereby providing the surface to be coated with a continuous supply of "fresh" electrolyte with which to form the coating.

In a preferred embodiment, the fluid supply network further includes a plurality of sparger nozzles, each of which is positioned within the tank opposite the first surface portion of a workpiece secured relative to its respective aperture. The sparger nozzles generate a swirling action which further serves to ensure that only "fresh" electrolyte, i.e. bubble-free electrolyte of desired temperature and composition, impinges upon the first surface portion of each workpiece during electrolysis. Moreover, the sparger nozzles are preferably formed of an electrically-conductive material so that they may be used as the electrode (cathode) of the electrolytic cell formed when its respective workpiece (one of the cell's anodes) is secured in its respective aperture and the electrolyte is directed into the plating tank.

For pre- and post-electrolytic treatment of the first surface portion of the workpieces, the fluid supply network preferably further includes additional storage tanks containing such pre- and post-electrolytic solutions, to be likewise circulated by the fluid supply network through the plating tank, preferably using the same sparging nozzles. A source of a rinsing fluid, such as tap water, is likewise provided so that the fluid supply network can direct the rinsing fluid into the plating tank to rinse the first surface portion of each workpiece, whereby any remaining electrolyte or other pre- or post-electrolytic solution is removed therefrom. In this regard, it is noted that the rinsing fluid, typically tap water directed into the plating tank through the sparging nozzles after a processing solution is drained therefrom, will preferably not be recirculated. Rather, such rinsing fluid is preferably drained from the plating tank and delivered by a separate conduit directly to suitable waste water treatment equipment.

And, in accordance with yet another feature of the invention, the storage tanks and other parts of the fluid supply network are preferably insulated to maintain the electrolyte and any other non-room-temperature solutions at their optimal temperatures, e.g., 32±2° F. (0±1° C.) for the sulfuric acid electrolyte used for hardcoat anodizing aluminum alloys. Since the electrolyte and other heated/cooled solutions circulated through the plating tank are themselves maintained in small, insulated storage tanks rather than the open processing tanks so typical of prior art methods, the energy requirements of the present apparatus and method are markedly reduced. As an added benefit of such circulation, the temperatures of the circulated solutions—particularly that of the electrolyte as it is sparged by the nozzles onto the workpiece—may be tightly regulated, with an attendant increase in coating quality and consistency.

Finally, under the present invention, the plating tank is preferably fully closed or sealed; and a second return conduit, connected to the plating tank at a point therein above the normal operating level of the electrolyte, extends from the plating tank to the storage tank. In addition to performing the function of an overflow return, the second return conduit serves to vent the byproducts of electrolysis, particularly the hydrogen gas generated thereby, back to the storage tank, either for recovery or for ultimate disposal. In this manner, the plating tank remains sealed to protect workers from the fumes generated by the coating process.

From the foregoing, it will be appreciated that, in accordance with the present invention, a plurality of electrically-conductive workpieces are sealingly secured in a like number of apertures provided in a wall of a plating tank such that only a desired surface portion of each workpiece is placed in fluid communication with the interior of the plating tank. With the wall of the plating tank thus "plugged" with the workpieces, a pre-electrolyte treating fluid may be first directed into and then drained from the plating tank. Examples of such pre-electrolyte treating fluids include, without limitation, known cleaning solutions, caustic etches, deoxidizing solutions, activating solutions and water. Indeed, a purge or rinsing fluid such as tap water is preferably directed into and subsequently drained from the plating tank immediately prior to the introduction of an electrolyte thereinto.

The electrolyte is then directed into and circulated through the plating tank, preferably through sparging nozzles, such that fresh electrolyte is continually sparged onto the exposed surface portion of each workpiece. With fresh electrolyte thus bridging both the workpieces and at least one electrode located within the plating tank (which electrode preferably comprises the very nozzle used to sparge the electrolyte onto each workpiece surface), a current is applied to the electrolyte to generate an electrolytic coating on the exposed surface of each anodic workpiece. In this manner, a coating of superior quality and consistency is obtained. In a preferred method, the plating tank is vented during electrolysis to a remote location for recovery or disposal of the heat and gas byproducts generated thereby.

Once the desired coating has been generated, the current is removed, the flow of electrolyte into the plating tank is stopped, and the plating tank is drained of electrolyte. A rinsing fluid such as tap water or other neutralizing solution is thereafter directed into the plating tank, preferably through the same sparging nozzles used for sparging pre-electrolyte treating fluids and electrolyte onto the exposed surface of each workpiece. In this manner, any remaining electrolyte is removed from the workpieces.

After the rinsing fluid is completely drained from the plating tank, any desired post-electrolyte treating fluid may be similarly directed into and subsequently drained from the plating tank, possibly with a further rinse of the plating tank in the manner described above. Examples of suitable post-electrolyte treating fluids include, without limitation, a sealant such as hot water, steam or sodium dichromate; a solution containing a dye; and a solution containing a dry lubricant such as polytetrafluoroethylene (PTFE or "Teflon®").

The workpieces are thereafter removed from their respective apertures and their respective masking/sealing assemblies to complete the processing thereof.

BRIEF DESCRIPTION OF THE DRAWINGS

Referring to the drawings, wherein like reference numerals are used to designate like elements in each of the several figures.

DETAILED DESCRIPTION OF THE PREFERRED EMBODIMENT

Figure 1:
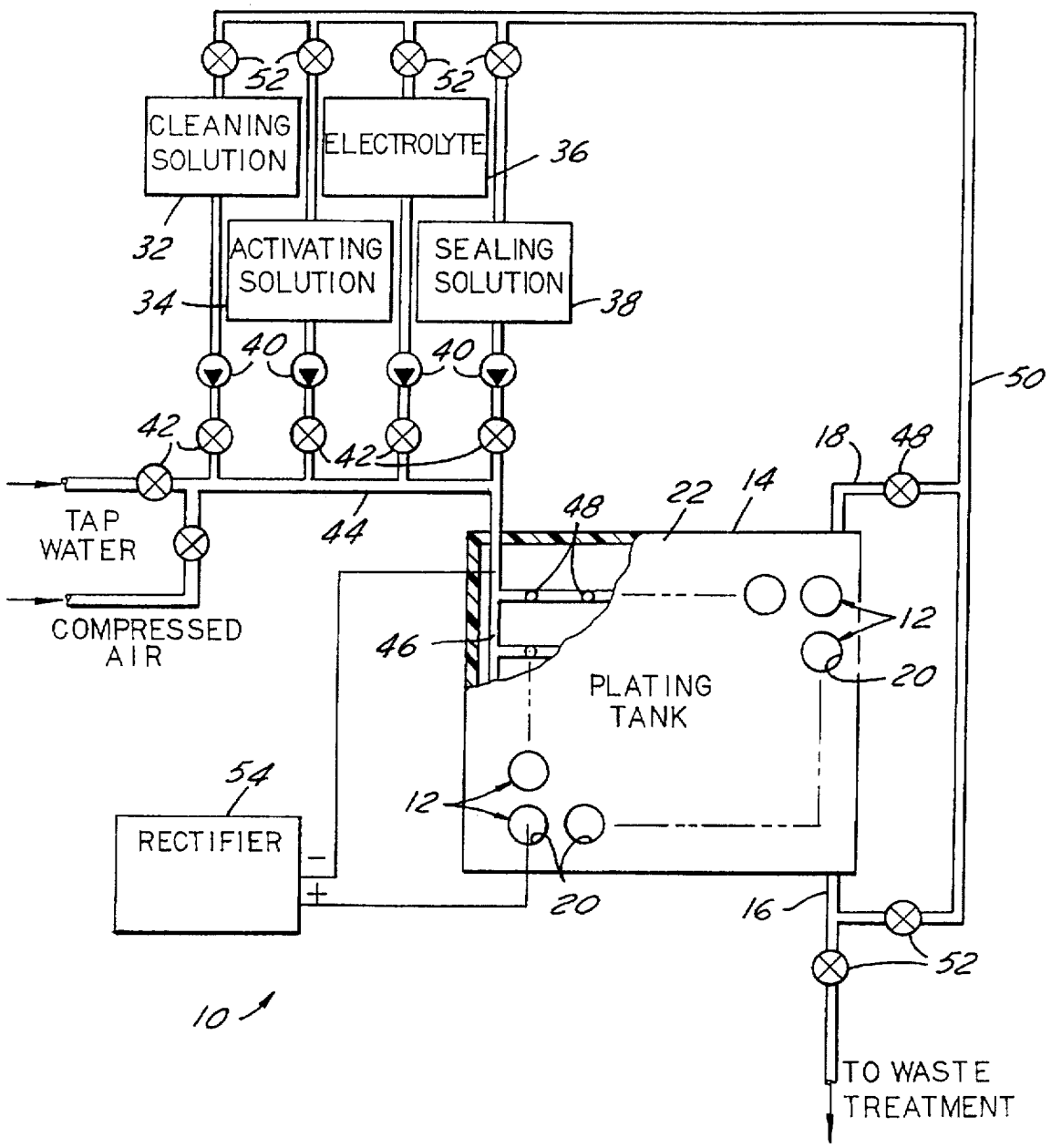
FIG. 1 is a schematic illustration of a preferred apparatus for cleaning, activating, hardcoat anodizing and rinsing the heads and peripheral lands of several aluminum pistons simultaneously in accordance with the present invention (for clarity, shown without the means for securing each piston in its respective aperture in the plating tank)

A preferred apparatus 10 for cleaning, deoxidizing, hardcoat anodizing and sealing the head of each of several aluminum pistons 12 simultaneously in accordance with the present invention is shown schematically in FIG. 1.

Figure 2:
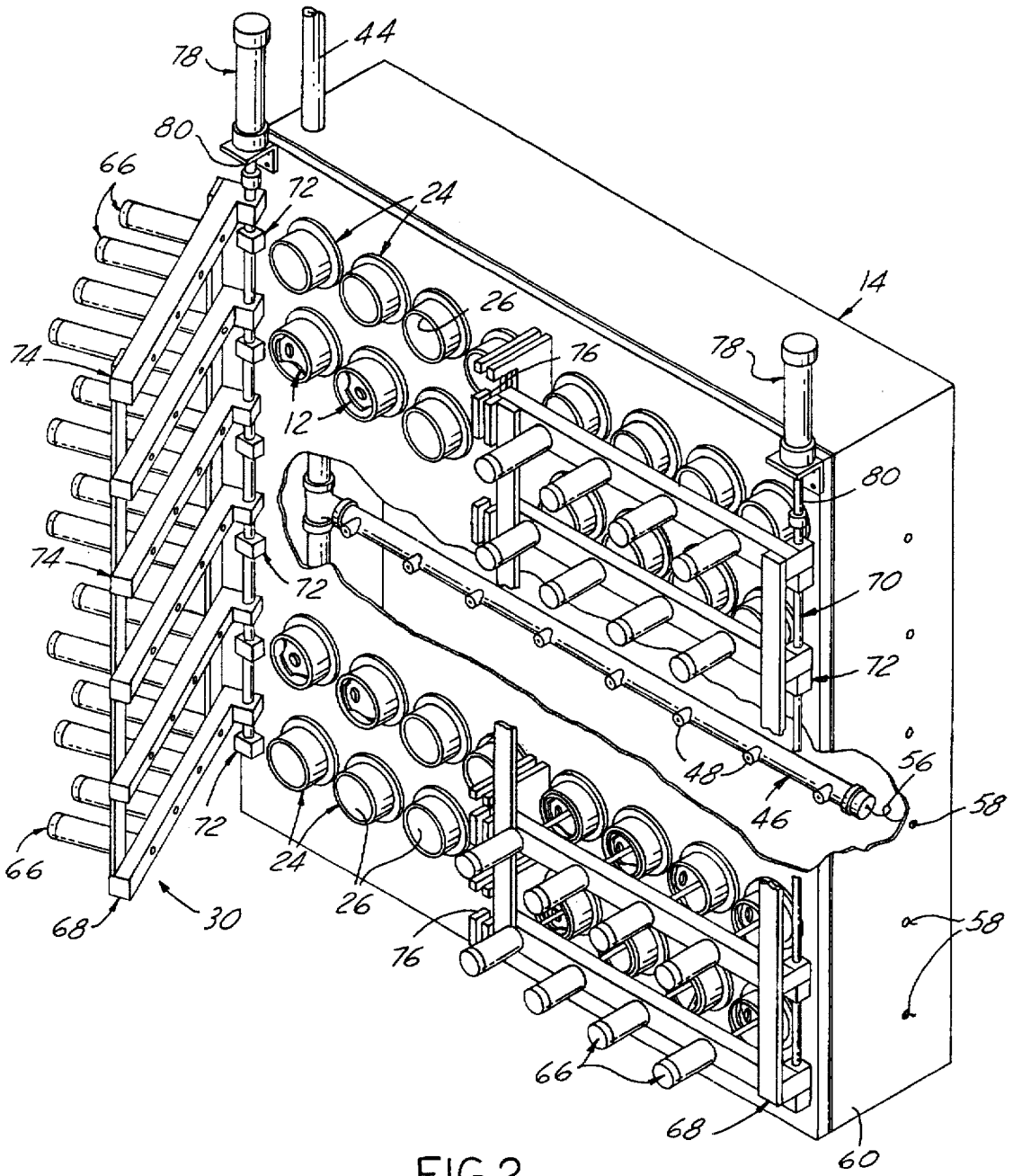
FIG. 2 is a view in perspective, partially broken away, of a plating tank constructed in accordance with the invention for use in simultaneously hardcoat anodizing the heads of several aluminum pistons, including fixtures for supporting the pistons in opposition to their respective apertures in the plating tank's front wall, and two arrays of pneumatic actuators pivotally mounted on the plating tank's front wall which, when pivoted and thereafter locked into alignment with the fixtures/apertures, operate to sealingly secure the pistons in their apertures (the broken-away portion of FIG. 2 further showing a supply conduit extending within the plating tank having integral sparging nozzles positioned thereon so as to be in opposition to the piston heads when they are secured relative to the apertures)
Figure 3:
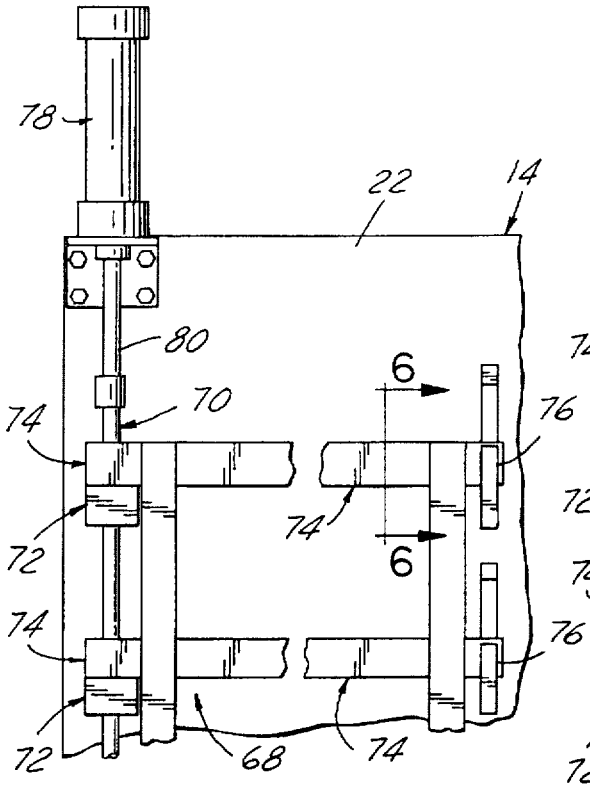
FIG. 3 is a partial front view of the plating tank showing one of the pivoting actuator arrays with its pneumatic actuators pivoted and locked into alignment with the plating tank's apertures.
Figure 4:
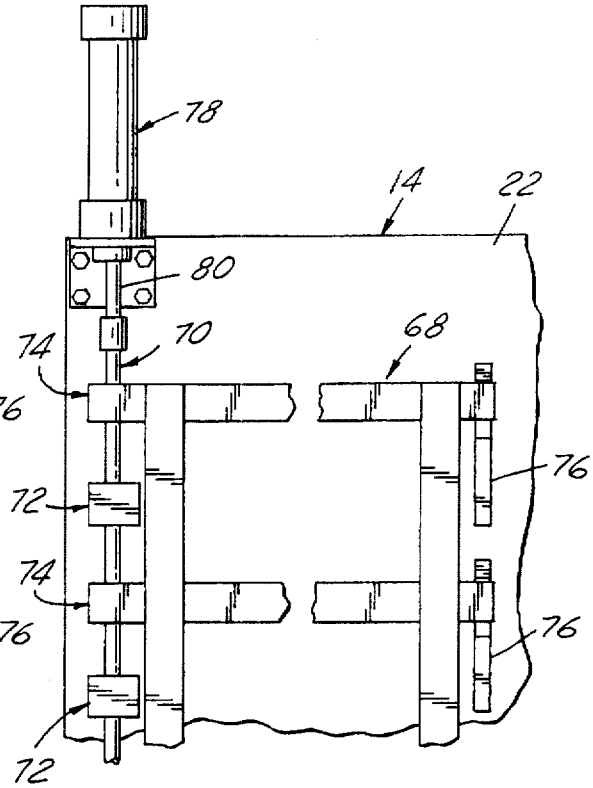
FIG. 4 is a partial front view of the plating tank similar to that of FIG. 3 showing one of the pivoting actuator arrays with its pneumatic actuators pivoted towards the plating tank's apertures, but neither aligned nor locked with respect to the apertures.
Figure 5:
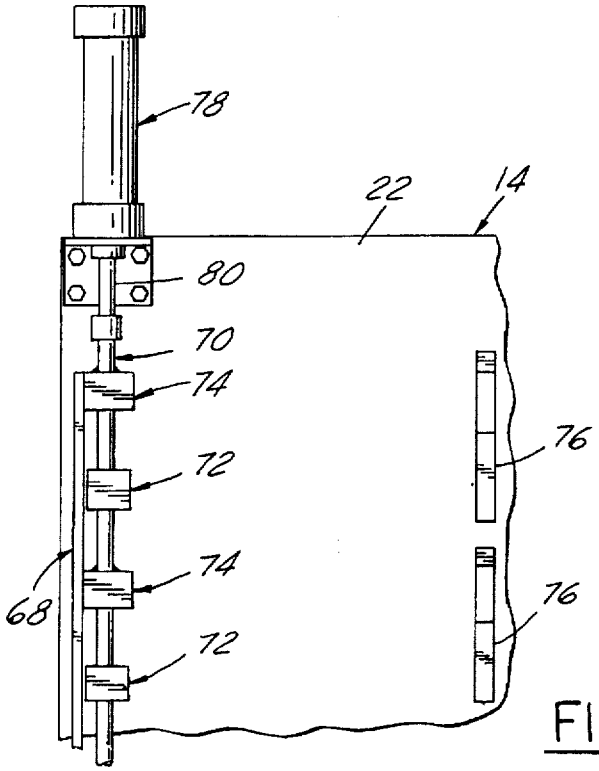
FIG. 5 is a partial front view of the plating tank similar to that of FIG. 3 showing one of the pivoting actuator arrays with its pneumatic actuators pivoted away from the front wall of the plating tank to facilitate insertion and removal of the pistons in the fixtures.
Figure 6:
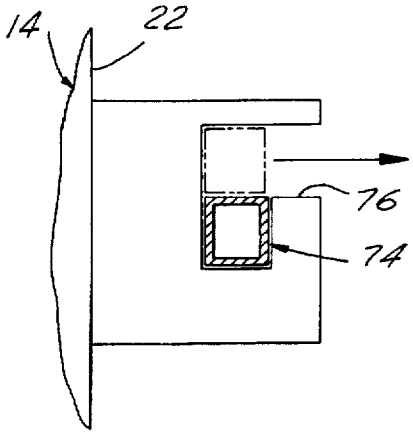
FIG. 6 is a partial view in cross-section along line 6—6 of FIG. 3 showing the locking mechanism for the pivoting actuator array.

Specifically, the apparatus 10 includes a sealed plating tank 14 (a detailed view of which is shown in FIG. 2). The plating tank 14, which is preferably formed of an electrically-nonconductive and thermally-insulative material such as ABS plastic, is nominally provided with a bottom drain 16 and an overflow/vapor return 18. The plating tank 14 also has an array of circular apertures 20 formed in its front wall 22. As will be described more fully below in connection with FIGS. 2, 9 and 10, the plating tank 14 further includes fixtures 24 secured to its front wall 22 to provide an elongate cylindrical bore 26 which is axially aligned with each of the plating tank's apertures 20. Each cylindrical bore 26 is adapted to receive and thereafter support an individual piston 14 inserted longitudinally thereinto, along with a suitable masking seal (the masking seal in the preferred embodiment disclosed herein itself comprises a piston masking/sealing assembly 28 which is described more fully below in connection with FIGS. 7–10). A seal is thereafter achieved about each piston 12 when the piston 12 is secured relative to the aperture 20 by appropriate securing means 30 (the securing means 30 being described below in connection with FIGS. 2–6, 9 and 10).

Returning to FIG. 1, the apparatus 10 further comprises a fluid supply network including several external storage tanks 32,34,36,38 containing a variety of solutions used in a preferred method for generating a hardcoat anodized surface on the head of each piston 12. For example, the first storage tank 32 is illustrated as containing an aqueous cleaning agent; the second storage tank 34, a commercial deoxidizer comprising nitric acid; the third storage tank 36, an aqueous solution of sulfuric acid ($H_2SO_4$) in a specified temperature range, e.g., at perhaps 32±2°F. (0±1° C.) (hereinafter "the electrolyte"); and the fourth storage tank 38, hot water maintained at over 200° F. (95° C.), to be used as a sealant. A source (not shown) of pressurized water at ambient temperature ("tap water") is also provided, as is a source of compressed hot or cold air (not shown). It is noted that the storage tanks 36,38 for the electrolyte and the hot water are preferably insulated to reduce energy requirements and are otherwise individually heated/cooled as required.

The precise formulation of the solutions contained within the storage tanks 32,34,36,38 will be known to those skilled in the plating arts. It should be appreciated, however, that the above-recited solutions are merely exemplary; other solutions suitable for use in the apparatus 10 include, without limitation, various rinsing and neutralizing solutions; caustic etches; other electrolytes; other sealing solutions, e.g., steam or sodium dichromate; solutions containing a dye to impart a desired color to the coating; and solutions containing a dry film lubricant such as "Teflon®" to make the coating "self-lubricating."The particular solutions, and the order and manner in which they are introduced into the plating tank 14, will be selected in a manner known to those skilled in the plating arts in order to achieve a particular coating on a given workpiece of specific hardness, toughness, density/porosity, wear-resistance, lubricity and/or color.

The fluid supply network also comprises dedicated pumps 40 and control valves 42 for connecting each storage tank 32,34,36,38 and the source of tap water to the plating tank 14 through a supply conduit 44. One end 46 of the supply conduit 44 projects into the interior of the plating tank 14. This end 46 of the supply conduit 44 is further provided with a plurality of integral sparging nozzles 48 positioned within the plating tank 14 in opposition to the apertures 20 formed in its front wall 22. In this manner, a given solution pumped from its respective storage tank 32,34,36,38 (as well as a tap water rinse) can be directed into the plating tank 14 and sparged directly onto the heads of the pistons 12 secured relative to the apertures 20. The fluid supply network further includes a network of return conduits 50 and control valves 52 for connecting the plating tank's drain 16 and overflow/vapor return 18 either to one of the storage tanks 32,34,36,38, or to suitable waste treatment equipment (not shown). In this manner, the fluid supply network is operated so as to circulate a given solution—and, particularly, the electrolyte—between its storage tank 32,34,36,38 and the plating tank 14, thereby ensuring that only "fresh" solutions are sparged upon the exposed surfaces of the piston 12.

As seen in FIG. 1, the apparatus 10 further includes a rectifier 54 for supplying current to the electrolytic cell created while the pistons 12 are secured relative to the plating tank's apertures 20 and the electrolyte from the third storage tank 36 is circulated through the plating tank 14 (whereupon the pistons 12 form the anode of the electrolytic cell). More specifically, in the preferred embodiment, the end 46 of the supply conduit 44 projecting into the plating tank 14 is preferably formed of an electrically-conductive, nonreactive material such as stainless steel so that it may be used as the electrode (cathode) during electrolysis, thereby obviating the need for a separate electrode. Accordingly, the negative terminal of the rectifier 54 is connected to that end 46 of the supply conduit 44, as by electric leads 56 extending within the plating tank 14 from the end 46 of the supply conduit 44 to a set of electric terminals 58 located on one of the plating tank's side wall 60. The positive terminal of the rectifier 54 is connected to the piston 12 when it is secured relative to the plating tank's aperture 20 (for clarity's sake, the positive terminal of the rectifier 54 is shown connected to but one of the pistons 12).

As noted hereinabove, the cylindrical bore 26 of each fixture 24 is adapted to receive and thereafter support one of the pistons 12 whose head 62 and peripheral land 64 is to be hardcoat anodized in the plating tank 14, along with a suitable masking seal. Referring to FIGS. 2–6, 9 and 10, the means 30 for securing each piston 12 into the cylindrical bore 26 of its respective fixture 24 (and, hence, secure each piston 12 "into" its respective aperture 20) includes a plurality of linear actuators, such as air cylinders 66, mounted in an array on each of two frames 68 which are themselves pivotally mounted to the front wall 22 of the plating tank 14 by means of a hinge shaft 70 and several hinge anchors 72.

Each frame 68 includes several locating beams 74 extending outwardly from the hinge shaft 72. When pivoted against the front wall 22 of the plating tank 14, each locating beam 74 engages a complementary locking lug 76 extending from the front wall 22 of the plating tank 14 to thereby lock the frame 68 relative thereto. Each frame 68 is further supported by an air cylinder 78 whose normally-extended shaft 80 is coupled with the top end of the hinge shaft 70. As seen in FIGS. 3–6, the air cylinder 78 is operable to lift the frame 68 relative to the front wall 22 of the plating tank 14 so as to allow the locating beams 74 to clear their corresponding locking lugs 76, thereby permitting the frame 68 to swing clear of the front wall 22.

Figure 7:
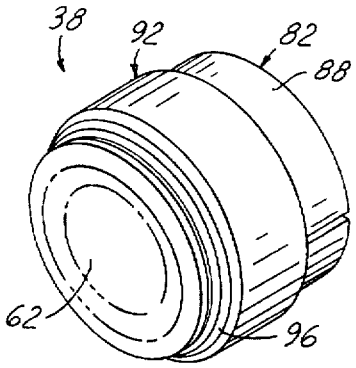
FIG. 7 is a view in perspective of a piston and its associated masking/sealing assembly prior to insertion in its respective fixture.
Figure 8:
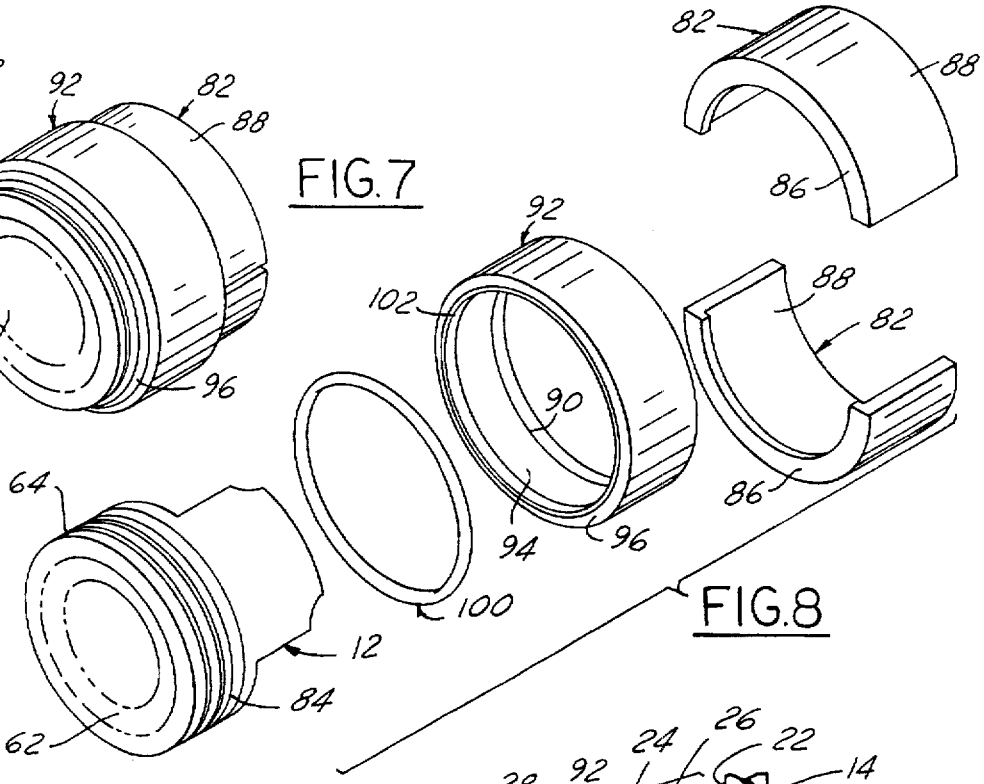
FIG. 8 is an exploded view in perspective of the piston and its associated masking/sealing assembly shown in FIG. 7.

Referring to FIGS. 7 and 8, the piston masking/sealing assembly 28 includes a pair of arcuate keying elements 82 which, when diametrically installed in one of the piston's circumferential grooves 84, provide axial load-bearing surfaces 86 projecting radially outwardly from the piston 12. The keying elements 82 preferably further include arcuate longitudinal extensions 88 which serve to further support the cylindrical body of the piston 12. The projecting surface 86 on each keying element 82 in turn engages an internal flange 90 on an annular, chemically-resistant collar 92 which itself encompasses a portion of the piston's cylindrical body. The radially-innermost portion 94 of the annular collar's internal flange 92 further serves to support and stabilize the piston 12 once inserted through the annular collar 92. The annular collar 92 further provides a sealing surface 96 which, upon insertion of the piston 12 and its associated masking/sealing assembly 28 into the bore 26 of the fixture 24, is placed in opposition to a complementary sealing surface 98 formed either internally of the fixture 24 or, as in the preferred embodiment shown in FIGS. 9 and 10, on the front wall 22 of the plating tank 14 adjacent the aperture 20.

The piston masking/sealing assembly 28 means further includes a seal, such as an O-ring seal 100, which is disposed about the piston 12 such that it will be seated between the sealing surface 96 on the annular collar 92 and the complementary sealing surface 98 on the front wall 22 of the plating tank 14. Most preferably, the sealing surface 96 on the annular collar 92 includes a chamfer 102 on its radially-innermost edge, i.e., forms an obtuse angle in cross-section with the exterior cylindrical body of the piston 12, and the O-ring 100 is initially seated against that chamfer 102, as seen in FIG. 8. The chamfer 102 ensures that the O-ring seal 100 will be compressed both axially and radially when the piston 14 is thereafter translated and secured relative to the aperture 20 by the air cylinder 66.

Figure 9:
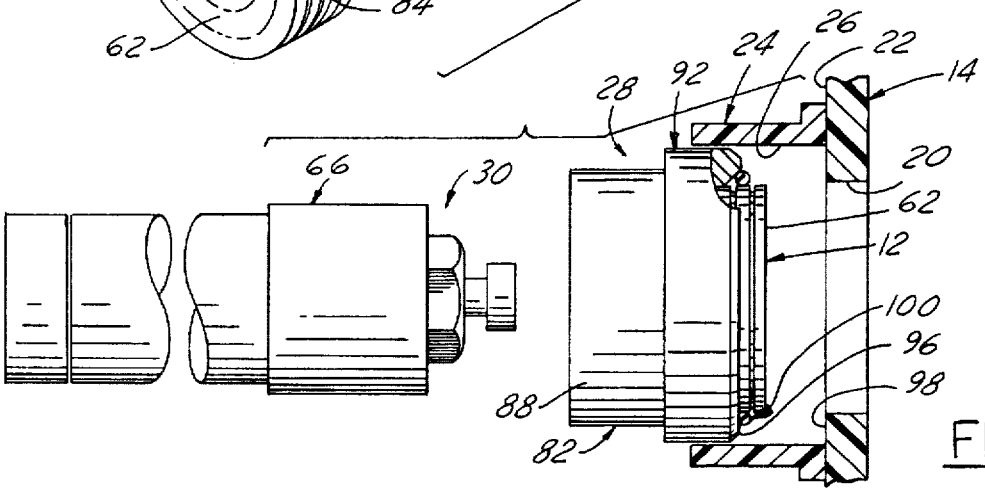
FIG. 9 is a partial side elevational view, partially in cross-section, showing an actuator pivoted and locked into alignment with a fixture containing a piston and its associated masking/sealing assembly, immediately prior to operation of the actuator.
Figure 10:
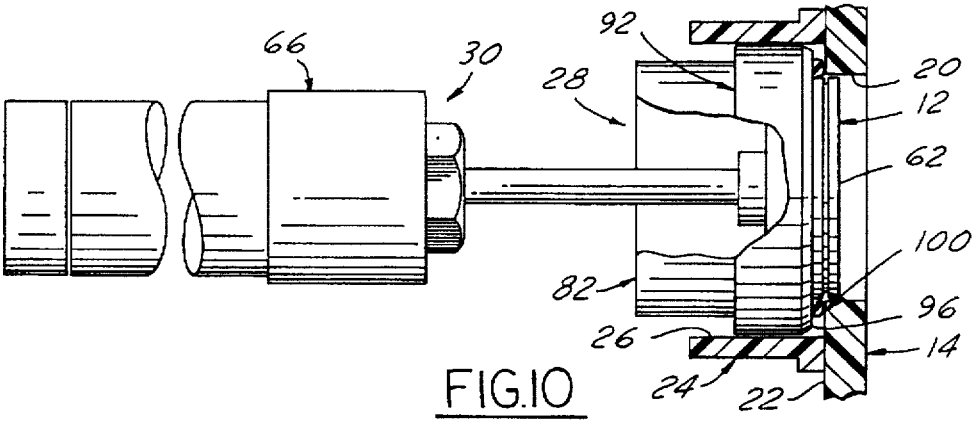
FIG. 10 is a partial side elevational view similar to that of FIG. 9 showing a piston and its associated masking/sealing assembly as translated and sealingly secured in opposition to its respective aperture in the front wall of the plating tank.

More specifically, as seen in FIGS. 9 and 10, once each frame 68 is pivoted and locked against the front wall 22 of the plating tank 14 and, hence, the air cylinders 66 it supports are pivoted and locked into alignment with the fixture bores 26, each air cylinder 66 is operated to translate the piston 12 supported by its respective fixture 24 towards the front wall 22 of the plating tank 14. The O-ring 100 will be axially compressed between the opposed sealing surfaces 96,98 while being further radially compressed by virtue of the chamfer 102 on the sealing surface 96 of the annular collar 92 so as to ensure a proper seal around the periphery of the piston 12 itself. And, since the O-ring 100 is radially compressed about the piston's body some distance from the piston's head 62, the piston's peripheral land 64 is also placed in fluid communication with the interior of the plating tank 14 when the piston 12 is otherwise secured relative to the aperture 20. The piston's head 62 and peripheral land 64 may thus be simultaneously coated using the present apparatus 10 upon circulation of the electrolyte within the plating tank 14 and application of electrolytic current across the anodic pistons 12 and the cathodic sparging nozzles 48. In this manner, the masking/sealing assembly 28 effects the sealing of the aperture 20 while effectively "masking" the piston 12 so as to permit the electrolytic coating of a selected portion of its exterior surface.

From the foregoing, it will be appreciated that each piston 12 whose head 62 and peripheral land 64 is to be coated with the present apparatus 10 is first placed in the masking/sealing assembly 28 as by inserting the arcuate key elements 82 in opposite sides of one of the piston's circumferential grooves 84 and then passing the keyed piston 12 longitudinally through the central aperture of the annular collar 92 until the key elements 82 seat against the annular collar's internal flange 90. The O-ring 100 is thereafter passed over the head 62 of the piston 12 and seated against the chamfer 102 formed in the annular collar's sealing surface 96 to thereby complete the masking/sealing assembly 28 as it encompasses the piston 12 to be masked/sealed therewith. The piston 12 and its associated masking/sealing assembly 28 are then inserted longitudinally into the cylindrical bore 26 of a fixture 24 on the front wall 22 of the plating tank 14, such that the O-ring 100 is placed in opposition with the complementary sealing surface 98 on the front wall 22 of the plating tank 14. The process is repeated until each and every aperture 20 in the plating tank's front wall 22 is loosely "plugged" by a piston 12 and its associated masking/sealing assembly 28.

The two frames 68 are then pivoted "shut" as by manually swinging the frame 68 towards the front wall 22 of the plating tank 14 while each frame 68 and, hence, its locating beams 74 are lifted over the locking lugs 76 by its hinge's air cylinder 78. The frames 68 are then lowered by their air cylinders 78 to engage their locating beams 74 with the locking lugs 76, thereby locking each air cylinder 66 into alignment with its respective aperture 20. The air cylinders 66 are then operated to translate the piston 12 and its associated masking/sealing assembly 28 towards the front wall 22 of the plating tank 14 to compress the O-ring 100 and, hence, seal each aperture 20 in the plating tank's front wall 22.

To remove the piston 12 from the aperture 20 after generating the desired coating, the above-described insertion/securing steps are reversed. Specifically, the operator will operate each air cylinder 66 so as to retract its shaft. Each frame 68 will be lifted by its respective air cylinder 78 to disengage its locating beams 74 from the locking lugs 76. The frame 68 is thereafter pivoted about its respective hinge shaft 70 away from the plating tank's front wall 22 to facilitate access to each of the pistons 12 as they remain in the fixtures 24. The thus-coated pistons 14 are then removed individually from the fixtures 24. The key elements 82, annular collar 92 and O-ring 100 of the masking/sealing assembly 28 are then removed from each piston 12 and retained for use in processing a subsequent load of pistons 12 to be coated with the present apparatus.

Finally, a brief discussion of the operation of the apparatus 10 once the pistons 12 have been secured relative to their respective apertures 20 in the plating tank 12: with the apertures 20 now "plugged" with the pistons 12, the plating tank 14 is ready to receive various processing solutions from the storage tanks 32,34,36,38, as well as intermediate and final tap water rinses. The solutions are selectively and sequentially directed by their dedicated pumps 40 from their respective storage tanks 32,34,36,38 into the supply conduit 44. The supply conduit 44 in turn feeds the sparging nozzles 48 positioned within the plating tank 14 in opposition to the heads 62 of the pistons 12, whereby the solutions are sparged onto the heads 62 and peripheral land 64 of the pistons 12. After each solution is drained from the plating tank 14, compressed air may be directed through the plating tank 14 and the supply and return conduits 44,50 to increase recovery thereof (and to correlatively normalize the temperature of the workpiece to prevent deleterious condensation upon removal of the workpiece from the plating tank 14). Depending upon the particular processing solution, the plating tank 14 may preferably also be rinsed with tap water prior to the directing thereinto of another solution or the removal of the workpieces from the plating tank 14.

When the sparged (and circulated) solution is the electrolyte, the rectifier 54 is operated to apply current across the electrolyte, with the piston 14 as anode and the sparging nozzles 48 as cathode. Meanwhile, heat and gas byproducts generated during electrolysis are vented from the plating tank 14 and, preferably, back to the electrolyte's storage tank 36 through the overflow/vapor return conduit 50. The venting of the heat and gas byproducts from the interior of the plating tank 14 ensures superior coating quality and consistency. Moreover, the hydrogen gas generated during electrolysis and vented from the plating tank 14 can either be recovered at the electrolyte storage tank 36 or otherwise vented to atmosphere at a location remote from the plating tank 14, thereby further promoting worker safety.

Since the temperature of the piston 12 will likely have been raised above ambient when the coated surface is sealed with hot water, there is little likelihood of condensation forming on the coated surface upon removal of the piston 12 from the plating tank 14. However, if the sealing step is eliminated (making the last solution a neutralizing rinse with tap water at room temperature), a greater likelihood exists that the temperature of the coated surface will be below ambient upon removal of the piston 12 from the plating tank 14, given the relatively-low temperature of the electrolyte. Therefore, in accordance with another feature of the invention, heated air is circulated through the plating tank 14 to normalize the temperature of the coated surface and, hence, prevent such later condensation of ambient moisture thereon upon removal of the pistons 12 from their respective apertures 20.

While the preferred embodiment of the invention has been disclosed, it should be appreciated that the invention is susceptible of modification without departing from the spirit of the invention or the scope of the subjoined claims. For example, while the invention has been described above in connection with the hardcoat anodizing of an aluminum piston, it should be appreciated that the apparatus 10 of the present invention is suitable for the electro-chemical treatment of a variety of other metals, including titanium and magnesium; and with a broad range of acid electrolytes/electrolyte temperatures.

We claim:

1. An apparatus for simultaneously generating an electrolytic coating on a first surface portion of each of at least two electrically-conductive workpieces using an electrolyte, said apparatus comprising:

a first tank having an interior defined in part by a wall having at least two apertures formed therein, and a drain;

at least one electrode extending into said first tank;

means mounted on said first tank for temporarily securing each of said workpieces relative to each of said apertures, respectively, said securing means including a plurality of fixtures adapted to receive and support said workpieces in alignment with said apertures, respectively, said securing means further including actuator means mounted on the first tank for translating said workpieces supported by said fixtures toward said apertures;

sealing means disposed between each of said workpieces and each of said apertures, respectively, for sealing said apertures about said workpieces when said workpieces are secured relative to said apertures, such that only the first surface portions of said workpieces are placed in fluid communication with the interior of said first tank;

a second tank for containing the electrolyte;

means for directing the electrolyte from said second tank into said first tank when said workpieces are secured relative to said apertures, such that the electrolyte bridges each of said workpieces and said at least one electrode; and a power supply connected to said workpieces and said at least one electrode, respectively, for applying a current across the electrolyte when the electrolyte is directed into said first tank, where an electrolytic coating is simultaneously generated on the first surface portion of each of said workpieces.

2. The apparatus of claim 1, wherein said actuator means is pivotally mounted on said first tank such that said actuator means pivots into and out of alignment with at least one of said apertures; and including means for locking said actuator means into alignment with said at least one of said apertures, said actuator means being operable to translate said workpieces supported by said fixtures toward said apertures when said actuator means is locked into alignment with said aperture.

3. The apparatus of claim 2, wherein said actuator means includes a pneumatic actuator.

4. The apparatus of claim 1, including means for returning the electrolyte from said first tank to said second tank during application of said current, where the electrolyte is circulated between the second tank and the first tank during generation of the electrolytic coating.

5. The apparatus of claim 1, wherein said means for directing the electrolyte into said first tank includes a sparger nozzle positioned within said first tank in opposition to the first surface portion of a first one of said workpieces when said first one of said workpieces is secured relative to a first one of said apertures.

6. The apparatus of claim 1, wherein said means for directing the electrolyte into said first tank includes a supply conduit extending from said second tank to said first tank; a first return conduit extending from the drain of said first tank to said second tank; and a pump operative to pump the electrolyte from said second tank through said supply conduit into said first tank.

7. The apparatus of claim 6, wherein said first tank is sealed; and including a second return conduit extending from said first tank to said second tank, said second return conduit being connected to said first tank at a point thereon above a normal operating level of the electrolyte in said first tank.

8. The apparatus of claim 6, including means on said second tank for maintaining the electrolyte contained therein at a desired temperature.

9. The apparatus of claim 1, wherein each of said workpieces has a cylindrical body, a head, and a circumferential groove axially spaced from the head; wherein each of said apertures defines a first annular sealing surface on the wall of said first tank; and wherein each of said sealing means includes at least one arcuate element adapted to be received in the circumferential groove on the cylindrical body of each workpiece, said at least one arcuate element projecting radially from the circumferential groove when received therein to present a projecting surface;

an annular collar having a central aperture adapted to receive the cylindrical body of each workpiece wherein said collar includes an internal surface engageable with the projecting surface of said at least one arcuate element when each workpiece is received in the central aperture, and wherein said annular collar defines a second annular sealing surface complementary to the first annular sealing surface on the wall of said first tank; and an O-ring positioned between the second annular sealing surface on said annular collar and the first annular sealing surface on the wall of said first tank.

10. The apparatus of claim 9, wherein said second annular sealing surface on said annular collar of each of said sealing means forms an obtuse angle with the cylindrical body of each workpiece, where said O-ring is compressed axially and radially when each workpiece is secured relative to the wall of said first tank.

11. The apparatus of claim 9, wherein said annular collar of each of said sealing means includes an internal surface complementary to the cylindrical body of each workpiece.

12. The apparatus of claim 9, wherein said O-ring of each of said sealing means encompasses the cylindrical body of each workpiece when each workpiece is secured relative to the wall of said first tank.

13. The apparatus of claim 9, wherein each of said fixtures includes a cylindrical bore, and wherein said annual collar includes an external surface complementary to the cylindrical bore of said fixture.

14. A method for simultaneously generating a coating on a first surface portion of each of at least two electrically-conductive workpieces, said method including the steps of:

placing said workpieces in at least two apertures extending through a wall of a sealed plating tank, said plating tank having an interior which is provided with sparger nozzles in opposition to said first surface portions of said workpieces when said workpieces are placed in said apertures, one of said workpieces to one of the apertures;

translating said workpieces toward said apertures to seal said workpieces in a respective aperture in said wall so that the first surface portion of each of said workpieces is placed in fluid communication with the interior of said plating tank;

energizing a dedicated pressure pump located in a supply conduit connecting a storage tank containing an electrolyte to said plating tank;

directing the electrolyte through said sparger nozzles for sparging the electrolyte onto the opposing first surface portions of said workpieces, said electrolyte bridging an electrode in said plating tank and the first surface portion of each of said workpieces;

applying a current through said electrolyte as said electrolyte bridges said workpieces and said electrode where an electrolytic coating is generated on the first surface portion of each of said workpieces;

said directing step including the step of circulating the electrolyte between said plating tank and said storage tank in fluid communication with said plating tank during said current application step;

draining said electrolyte from said plating tank; and removing said workpieces from said apertures.

15. The method of claim 14 which includes, after said draining step and prior to said removing step, the steps of:

directing a rinsing fluid through said supply conduit and sparger nozzles for sparging the rinsing fluid onto the first surface portions of said workpieces to remove therefrom any remaining electrolyte which is directed into the plating tank; and draining the rinsing fluid from the plating tank.

16. The method of claim 14 which includes, after said placing step and prior to said directing step, the steps of:

directing into said plating tank through said sparger nozzles and onto the opposing first surface portions of said workpieces a pre-electrolyte treating fluid selected from the group consisting of a cleaning solution, a deoxidizing solution, a caustic etch, an activating solution, and water; and draining said pre-electrolyte treating fluid from said plating tank.

17. The method of claim 14 which includes, after said draining step and prior to said removing step, the steps of:

directing into said plating tank through said sparger nozzles and onto the opposing first surface portions of said workpieces a post-electrolyte treating fluid selected from the group consisting of a sealing solution, a solution containing a dye, and a solution containing a dry lubricant;

maintaining said post-electrolyte treating fluid in contact with the first surface portions of said workpieces for a time period; and draining said post-electrolyte treating fluid from said plating tank.

18. The method of claim 14 which further includes the step of directing heated air into said plating tank to raise the temperature of the coated surfaces after said draining step and prior to said removing step.

19. The method of claim 14 where the electrolyte in said plating tank is below room temperature, said method further including the step of heating said workpieces to room temperature prior to said removing step.

20. The method of claim 14 which includes the step of venting during electrolysis said plating tank to a location remote from said plating tank for recovery or disposal of any heat and gas byproducts which are generated.

* * * * *